United States Patent [19]

Pawlowski

[11] Patent Number: 4,896,009

[45] Date of Patent: Jan. 23, 1990

[54] GAS PERMEABLE MICROWAVE REACTIVE PACKAGE

[75] Inventor: Thomas D. Pawlowski, Neenah, Wis.

[73] Assignee: James River Corporation, Norwalk, Conn.

[21] Appl. No.: 217,534

[22] Filed: Jul. 11, 1988

[51] Int. Cl.[4] ..... H05B 6/04

[52] U.S. Cl. ..... 219/10.55 E; 219/10.55 F; 426/107; 426/234; 426/243; 99/DIG. 14

[58] Field of Search ..... 219/10.55 E, 10.55 F; 99/DIG. 14; 126/390; 426/107, 113, 234, 241, 243

[56] References Cited

U.S. PATENT DOCUMENTS

| | | | |
|---|---|---|---|
| 4,027,132 | 5/1977 | Levinson | 219/10.55 |
| 4,190,757 | 2/1980 | Turpin | 219/10.55 |
| 4,196,331 | 4/1980 | Leveckis et al. | 219/10.55 E |
| 4,230,924 | 10/1980 | Brastad | 219/10.55 |
| 4,267,420 | 5/1981 | Brastad | 219/10.55 |
| 4,360,107 | 11/1982 | Roccaforte | 206/626 |
| 4,398,077 | 8/1983 | Freedman | 219/10.55 |
| 4,553,010 | 11/1985 | Bohrer | 219/10.55 |
| 4,555,605 | 11/1985 | Brown | 219/10.55 |
| 4,567,341 | 1/1986 | Brown | 219/10.55 E |
| 4,641,005 | 2/1987 | Seiferth | 219/10.55 |
| 4,745,249 | 5/1988 | Daniels | 219/10.55 E |
| 4,777,053 | 10/1988 | Tobelmann et al. | 219/10.55 E X |
| 4,814,568 | 3/1989 | Keefer | 219/10.55 E |

*Primary Examiner*—Philip H. Leung

*Attorney, Agent, or Firm*—Sixbey, Friedman, Leedom & Ferguson

[57] ABSTRACT

A disposable microwave browning and crisping package having a flat substrate and a microwave reactive layer affixed over one surface of said substrate, the microwave interactive layer, when subjected to microwave energy, converting microwave energy to heat in an amount sufficient to brown and crisp food in heat transfer relationship has at least one aperture to allow gases and vapors generated from cooking foods such as large pie crusts to traverse said laminate thereby allowing the food product to remain in close proximity to the reactive heater resulting in improved browning and crisping.

8 Claims, 1 Drawing Sheet

GAS PERMEABLE MICROWAVE REACTIVE PACKAGE

BACKGROUND OF THE INVENTION

1. Field of the Invention

The present invention relates to a disposable microwave reactive cooking, crisping, and browning food package which produces a thermal heating effect when exposed to microwave energy and which contains gas permeable means to allow venting of gases and vapors which improve browning and crisping of the contained food product.

2. Background Art

The number of microwave ovens in use has grown tremendously in recent years. Associated with this growth in microwave oven usage has been a similar growth in the demand for microwaveable prepared foods. As manufacturers of microwaveable prepared foods seek to introduce new and different kinds of food products, they are often faced with the problem of how to compensate for the difference in results when heating foods in a microwave oven, compared to heating in a conventional oven. Among these problems is the common complaint that food cooked by microwave energy lacks the desired degree of brownness and crispness that foods such as pizzas have when cooked in a conventional oven. With browning and crisping as the objective, numerous specialized microwaveable food packages have been developed. Many such specially developed packages, however, are not adaptable to foods which, during microwave heating, produce grease and vapor which cause the product to become soggy and soft. Furthermore, certain specialized packages which have been designed to overcome some of these problems are expensive and therefore not disposable.

Specialized packages developed and designed to achieve microwave browning of foods contain a reactive film or element which converts microwave energy into thermal energy. The thermal energy produces browning and crisping of an item of food situated adjacent said heating element. In some cases the food is disposed within an outer package body that is used for shipping and storage as well as for heating of the food product. In other cases, the food is disposed on a tray-like member that is situated within an outer package body for shipping and storage, but is removed and rearranged relative to the outer package body when the food item is prepared for heating in a microwave oven.

One type of disposable package that is used for both shipping and storage as well as heating of items of food is represented by Brastad U.S. Pat. No. 4,267,420 and Brastad, et al. U.S. Pat. No. 4,230,924. In these patents, flexible and semi-rigid sheets of microwave interactive materials are wrapped closely about individual items of food so that when the package is exposed to microwave energy, at least a portion of the microwave energy impinging the package will be converted into heat for browning the surface of the food. However, such packages have been found to pose problems with various types of food which give off heat, grease, and/or vapor. Furthermore, irregularly shaped foods are difficult to wrap. As a result, uneven heating, browning, and cooking of the food has been experienced.

Another example of a specialized reactive package is disclosed in U.S. Pat. No. 4,190,757 to Turpin. This patent discloses a carton for microwave heating of pizza including an interactive layer which converts microwave energy to heat for browning the pizza crust and a spacer element for elevating the interactive layer above the bottom wall of the carton. Because of the specialized and complex configuration of the carton assembly, manufacturing and production costs are excessive. Moreover, because this carton has a planar panel of interactive material without a gas permeable aperture for venting, it does not provide an effective means for microwave browning and crisping of foods such as large pizzas having crust diameters in excess of seven (7) inches.

Certain packages utilizing interactive layers require some form of manipulation prior to use or are limited in their uses, such as commonly assigned U.S. Pat. No. 4,553,010 to Bohrer and U.S. Pat. No. 4,555,605 to Brown. The packaging arrangements disclosed in these patents are extremely well suited for the microwave heating of certain types of food, such as popcorn in the case of Bohrer and small diameter pizza in the case of the Brown, but these arrangements do not deal with the problems associated with microwave cooking of certain types of foods, particularly those having large diameter pie crusts. The planar nonporous nature of the reactive support surface on which the food product is placed limits its use to browning and crisping food products which have small planar areas adjacent the reactive heater.

SUMMARY OF THE INVENTION

In view of the foregoing, it is an object of the present invention to provide a disposable microwavable package assembly to serve the functions of shipment, storage, and microwave heating of food in a manner which produces a browning and crisping effect which is particularly adapted to the needs of foods such as large pies and pizzas.

It is another object of the present invention to provide a novel and improved package assembly wherein the bottom laminate contains gas permeable means which allow the crust to remain in contact with the reactive laminate.

It is yet another object of this invention to provide a package assembly wherein the bottom laminate is microwave reactive to facilitate improved crisping of large pie crust resting thereon.

It is also an objective to construct a laminate having a semirigid base and a microwave reactive heater for cooking, browning, and crisping pie crusts and which costs are suffiently low so as to allow disposal of the package after its use.

It is a specific object of the present invention to secure the preceding objectives and improvements through the use of pores or holes in the base laminate, said holes preferably located in the center of the base laminate so as to maximize the effect of the microwave reactive layer on browning and crisping of the pie crust.

DETAILED DESCRIPTION OF THE INVENTION

Figure 1:
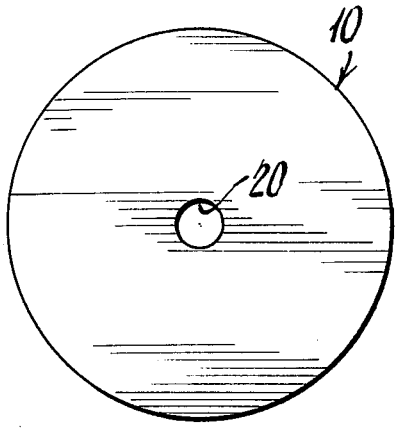
FIG. 1 is a top view of a circular browning and crisping laminate illustrating the features of the invention.
Figure 2:
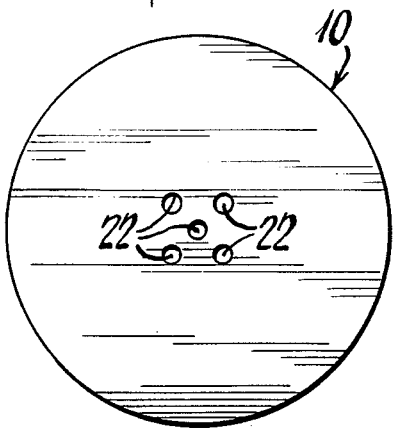
FIG. 2 is a top view of a circular browning and crisping laminate showing an alternative embodiment of the invention.
Figure 3:
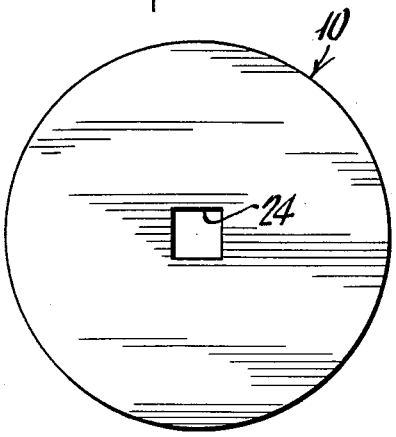
FIG. 3 is a top view of a circular browning and crisping laminate showing a third embodiment of the invention.
Figure 4:
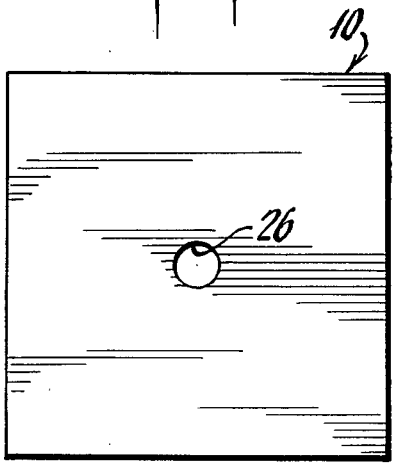
FIG. 4 is a top view of a square browning and crisping laminate illustrating a fourth embodiment of the invention.

A microwave browning and crisping laminate is designated by the reference numeral 10. FIGS. 1, 2, and 3 illustrate the present invention having the configuration of a circular microwave browning and crisping laminate. FIG. 4 illustrates a microwave browning and crisping laminate having a square or rectangular construction. In either case, the pizza pie is placed over the laminate and remains there for storage, shipment, and ultimate use by the consumer. Because of its ease of packaging, the square microwave browning and crisping laminate is more popular. However, the circular configuration of the reactive heater produces the best results. Under these circumstances, all of the microwave reactive heater is placed adjacent the pie crust where it best serves its purpose.

FIG. 1 is the simplest configuration of the present invention. The browning and crisping laminate 10 is circular in shape and has at its center a vapor and gas permeable aperture. Although aperture size is not extremely critical, it has been found that an aperture having a diameter of approximately $\frac{3}{8}$ inch produces the best results for pizza pie crusts having diameters between 7 and 12 inches.

As mentioned previously, the simplest embodiment of the present invention is illustrated in FIG. 1. It has been found that upon decreasing the diameter of the aperture 20, the browning and crisping of the pie crust in the vicinity of the aperture decreases. The explanation for this decrease in browning and crisping appears to be the results of steam vapor and gases being generated between the laminate and pie crust, thereby lifting the pie crust from its position against MYLAR film 50 and reactive heater 60. Vapor and gases can be trapped between the bottom of the crust and the surface 50 in some cases where the surface 50 structure is out of contact with the crust due to a doming thereof.

In the event that the aperture 20 is made excessively large, additional microwave reactive element is removed from the center location of the laminate. Since the presence of the microwave reactive laminate is necessary to produce thermal heating which in turn produces good browning and crisping, it has been found that removal of material in excess of that required for adequate venting provides a pie crust which is soft and soggy in the center. Test results show that an aperture diameter of approximately $\frac{3}{8}$ inch is best suited for commercial type pizza pies having diameters between 7–12 inches.

Although aperture 20 could consist of porous fibers or other porous material, the most economical construction has been to provide a void or a hole in the laminate portion of the package. For storage and transportation of the pizza pie, it has been determined that the product is preserved best by having the pie placed on the laminate and the entire unit then surrounded by conventional packaging material which provides a vapor barrier between the product and surrounding area. In preparing the pizza for cooking, the outer package is removed and the pizza together with the browning and crisping laminate are inserted into the microwave oven.

FIG. 2 illustrates a second embodiment of the current invention. The browning and crisping laminate 10 is circular in shape but instead of having one apertured 20 in the center of the laminate, several small apertures are placed in the immediate area of the center of the laminate. The small circular apertures 22 allow steam vapor and gases to escape while allowing the remaining microwave reactive film to perform the crisping and browning function. Test results have shown that the number, size, and shape of apertures should be sufficient to allow adequate venting such that the pie crust remains in contact with the MYLAR film 50. Too little venting will cause the pie crust to lift and separate from the MYLAR film 50. Too much venting removes too large an area of the reactive film layer 60 which results in a soft, soggy, and white crust in the area of the aperture. Thus, all of the illustrated embodiments confine their vent aperture(s) to a central surface area of the support surface of laminate 10, while the remaining surface area is free of apertures and is greater than the central surface area. Furthermore, relative to the FIG. 2 embodiment, experimentation has shown that five small apertures of any shape having openings of approximately 1/5 of an inch across provides good results with large diameter pizzas.

Illustrated in FIG. 3 is another embodiment of the present invention. The browning and crisping laminate 10 is circular in shape but the venting aperture in this configuration is either square or rectangular. This aperture is designated 24 in FIG. 3. As mentioned in previous embodiments of the invention, the configuration of the aperture 24 is not critical to the successful exercise of the present invention. The aperture 24 should be sufficiently small to allow as much of the microwave reactive film layer 60 to remain in contact with all portions of the pie crust but at the same time allow for adequate venting of steam, gases, and vapor. Although this embodiment shows the removal of the microwave reactive film in the area of the aperture 24, it is conceivable that a porous microwave reactive heater could be used, in which case the reactive heater would be adjacent to the pie crust at all points while allowing all generated gases or vapors to be vented as necessary. Although currently commercially available microwave reactive materials are nonporous, it is conceivable that at a future date a porous microwave reactive layer could be substituted for the aperture 24. Experimentation has shown that a $\frac{3}{8}'' \times \frac{3}{8}''$ inch square void in the center of the laminate 10 provides adequate venting for large commercial size pizzas.

FIG. 4 illustrates the microwave browning and crisping laminate constructed in either a square or a rectangular fashion. The aperture 26 is still located within the center of the laminate but the laminate itself is not circular in shape. Alternative embodiments of the invention would consist of a circular microwave reactive heater on a rectangular or square substrate. This could facilitate packaging of the pizzas since conventional packages are in most instances square or rectangular rather than circular. In either case, the aperture 26 could consist of a void or space, porous fibers, or other porous material allowing venting.

Figure 5:
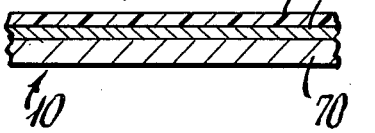
FIG. 5 is cross-sectional view of a browning and crisping laminate showing the construction thereof.

FIG. 5 illustrates the typical construction of a microwaveable browning and crisping laminate. Film designated 50 is typically a MYLAR or polyester film and is normally that part of the laminate in contact with the food product. Below the film 50 is the microwave reactive layer 60, typically an extremely thin film of aluminum, which creates thermal heating when exposed to microwave energy. Substrate 70 provides some rigidity to the laminate and is customarily paper, paperboard, plastic, or other acceptable packaging material.

The microwave reactive film 60 consists of a very thin lossy layer of aluminum having a surface resistance between 1 and 20 ohms per square inch. As noted in the prior art, the thickness of the aluminum layer is not directly measurable, but calculations indicate that a film of aluminum used as the metal layer would have a thickness of between 200 and 300 angstroms if its resistance would be approximately 1.5 ohms per square inch.

The metal layer 60 must be sufficiently thin for it to be readily and rapidly heated upon exposure to microwave radiation. Such heating of the layer must be rapid and must reach a sufficient temperature so as to brown and crisp the exterior of the pie crust during the normal cooking cycle.

It has been found that a reactive layer having a surface resistance of approximately 2 ohms per square inch is capable of achieving a temperature in excess of 200° F. within 30 seconds in a conventional 600 watt microwave oven. Likewise, a reactive layer having a surface resistance of approximately 4 ohms per square inch will achieve a temperature exceeding 200° F. when exposed to microwave energy for a period of 20–30 seconds. It has been found that as the surface resistance of the reactive layer increases, the faster the layer heats up when exposed to microwave radiation.

Although a lossy layer of aluminum was used as the energy absorbing reactive heater in the preceding examples, a very thin layer of lossy material made from other metal and metal compounds could be used. Ferrites and carbon particles could also be used. The lossy layer of material may be applied to the substrate by vacuum vapor deposition, as suggested in U.S. Pat. No. 4,461,005 or by a relatively thin paint layer as suggested in U.S. Pat. No. 4,190,757.

An alternative configuration of the laminate would consist of a circular microwave heating element placed on a square semirigid substrate which would then become an integral part of the package. Regardless of the configurations, it is essential that the microwave reactive element be adjacent the pie crust and remain there throughout the cook cycle. Construction economies dictate that the most effective use of the reactive heater is obtained when all segments of the reactive heater are adjacent to a portion of the pie crust. For this reason, a circular microwave reactive heater is preferred over a rectangular one. The substrate upon which the reactive heater is placed could be of any configuration, either circular, square or rectangular, without negatively affecting the performance of the crisping and browning laminate 10.

It should be recognized that while various embodiments in accordance with the present invention have been described, the present invention will be susceptible to numerous other changes and modifications which will become apparent to those skilled in the art from the foregoing disclosure. Therefore, the present invention should not be considered to be limited to the details shown and described herein, but emcompasses all such changes and modifications as are within the scope of the appended claims.

What I claim is:

1. In a microwave browning and crisping arrangement of the type including a substrate having a substantially planar support surface on which is laminated a browning and crisping layer forming a microwave interactive means for converting microwave energy to heat in an amount sufficient to brown and crisp food; and a food item having a bottom surface resting in contact with the browning and crisping layer on said planar support surface; the improvement, as a means for producing improved browning and crisping of said bottom surface of the food item by maintaining said contact between the bottom surface of the food item and the browning and crisping layer, comprising at least one aperture being provided through said substrate, said at least one aperture being confined to a central area of said support surface and the remaining surface area of the support surface being free of apertures, said remaining surface area being greater than said central surface area.

2. A microwave browning and crisping arrangement according to claim 1 wherein said bottom surface is at least approximately 7″ in diameter.

3. A microwave browning and crisping arrangement according to claim 2, wherein said at least one aperture is a hole of approximately ⅜″ diameter.

4. A microwave browning and crisping arrangement according to claim 1, wherein said at least one aperture is a hole of approximately ⅜″ diameter.

5. A microwave browning and crisping arrangement according to claim 1, wherein said at least one aperture comprises a single centrally positioned hole of approximately ⅜″ diameter.

6. A microwave browning and crisping arrangement according to claim 1, wherein said at least one aperture comprises a centrally positioned aperture and a plurality of additional apertures disposed in a pattern therearound and wherein said apertures are holes of approximately ⅜″ diameter.

7. A microwave browning and crisping arrangement according to claim 1 wherein said at least one aperture comprises a centrally positioned aperture and a plurality of additional apertures disposed in a pattern therearound.

8. A microwave browning and crisping arrangement according to claim 1, wherein said at least one aperture comprises a single centrally positioned aperture.

* * * * *